US005789365A

United States Patent [19]

Blokzijl et al.

[11] Patent Number: 5,789,365

[45] **Date of Patent: *Aug. 4, 1998**

[54] DETERGENT COMPOSITIONS CONTAINING SOIL RELEASE POLYMERS

[75] Inventors: Wilfried Blokzijl, Amsterdam, Netherlands; Andrew Martin Creeth, Chester, United Kingdom; Mohamad Sami Falou, Cheadle, United Kingdom; Andrew David Green, Liverpool, United Kingdom; Michael Hull, Gwynedd, United Kingdom; Reginald Vear Scowen, Wirral, United Kingdom

[73] Assignee: Lever Brothers Division of CONOPCO Inc., New York, N.Y.

[ * ] Notice: The term of this patent shall not extend beyond the expiration date of Pat. No. 5,786,318.

[21] Appl. No.: 755,509

[22] Filed: Nov. 22, 1996

[30] Foreign Application Priority Data

Nov. 30, 1995 [GB] United Kingdom ..... 9524494

[51] Int. Cl.[6] ..... C11D 3/37

[52] U.S. Cl. ..... 510/292; 510/299; 510/300

[58] Field of Search ..... 510/292, 299

[56] References Cited

U.S. PATENT DOCUMENTS

| | | | |
|---|---|---|---|
| 3,557,039 | 1/1971 | McIntyre et al. | 260/29.2 |
| 4,714,479 | 12/1987 | Wilsberg | 510/292 |
| 4,721,580 | 1/1988 | Gosselink | 510/299 |
| 4,968,451 | 11/1990 | Schelbel et al. | 252/549 |
| 4,976,879 | 12/1990 | Maldonado et al. | 252/8.7 |
| 5,047,165 | 9/1991 | Lysy et al. | 510/292 |
| 5,182,043 | 1/1993 | Morrall et al. | 252/174 |
| 5,196,133 | 3/1993 | Leslie et al. | 510/299 |
| 5,415,807 | 5/1995 | Gosselink et al. | 252/174.21 |
| 5,599,782 | 2/1997 | Pan et al. | 510/299 |

FOREIGN PATENT DOCUMENTS

| | | |
|---|---|---|
| 001 305 | 4/1979 | European Pat. Off. . |
| 164 514 | 12/1985 | European Pat. Off. . |
| 185 427 | 6/1986 | European Pat. Off. . |
| 241 984 | 10/1987 | European Pat. Off. . |
| 241 985 | 10/1987 | European Pat. Off. . |
| 272 033 | 6/1988 | European Pat. Off. . |
| 311 342 | 4/1989 | European Pat. Off. . |
| 340 013 | 11/1989 | European Pat. Off. . |
| 357 280 | 3/1990 | European Pat. Off. . |
| 367 339 | 5/1990 | European Pat. Off. . |
| 384 070 | 8/1990 | European Pat. Off. . |
| 390 251 | 10/1990 | European Pat. Off. . |
| 420 317 | 4/1991 | European Pat. Off. . |
| 1 437 950 | 6/1976 | United Kingdom . |
| 1 467 098 | 3/1977 | United Kingdom . |
| 1 470 250 | 4/1977 | United Kingdom . |
| 1 473 201 | 5/1977 | United Kingdom . |
| 1 473 202 | 5/1977 | United Kingdom . |
| WO 92/04433 | 3/1992 | WIPO . |
| WO 93/21294 | 10/1993 | WIPO . |
| WO 94/22937 | 10/1994 | WIPO . |
| WO 95/02029 | 1/1995 | WIPO . |
| WO 95/32997 | 12/1995 | WIPO . |

OTHER PUBLICATIONS

Derwent Abstract of EP 164 514.

Derwent Abstract of WO 95/32997.

International Search Report in International Application No. PCT/EP 96/05002.

Derwent Abstract of JP3021698 published Jan. 30, 1991.

Derwent Abstract of JP51743400 published Sep. 4, 1982.

*Primary Examiner*—Ellen M. McAvoy
*Attorney, Agent, or Firm*—Rimma Mitelman

[57] ABSTRACT

A laundry detergent composition contains a surfactant system consisting wholly of anionic surfactant, or of anionic and nonionic surfactants in a ratio at least 0.9:1, a detergency builder, and a soil release polymer which is a defined water-soluble or water-dispersible sulphonated non-end-capped polyester, for example, of terephthalic acid, isophthalic acid, sulphoisophthalic acid and ethylene glycol.

10 Claims, No Drawings

DETERGENT COMPOSITIONS CONTAINING SOIL RELEASE POLYMERS

TECHNICAL AREA

The present invention relates to laundry detergent compositions containing certain water-soluble or water-dispersible polyesters exhibiting improved soil release properties.

BACKGROUND AND PRIOR ART

Polyesters of terephthalic and other aromatic dicarboxylic acids having soil release properties are widely disclosed in the art, in particular, the so-called PET/POET (polyethylene terephthalate/polyoxyethylene terephthalate) and PET/PEG (polyethylene terephthalate/polyethylene glycol) polyesters which are disclosed, for example, in U.S. Pat. No. 3 557 039 (ICI), GB 1 467 098 and EP 1305A (Procter & Gamble). Polymers of this type are available commercially, for example, as Permalose, Aquaperle and Milease (Trade Marks) (ICI) and Repel-O-Tex (Trade Mark) SRP3 (Rhône-Poulenc). Other patent publications disclosing soil release polymers which are condensation products of aromatic dicarboxylic acids and dihydric alcohols include EP 185 427A, EP 241 984A, EP 241 985A and EP 272 033A (Procter & Gamble).

EP 357 280A (Procter & Gamble) discloses sulphonated end-capped linear terephthalate oligomers which are condensation products of a low molecular weight diol, preferably propylene glycol or ethylene glycol, with terephthalic acid.

The present invention is based on the use of a class of non-end-capped sulphonated polyesters based on dicarboxylic acids and polyols which provide especially effective soil release, especially from polyester fabrics, and which are also effective in reducing soil redeposition in the wash.

DEFINITION OF THE INVENTION

The present invention accordingly provides a detergent composition for washing fabrics, comprising:

(a) from 2 to 50 wt % of an organic surfactant system which comprises a sulphate or sulphonate type anionic surfactant, optionally in combination with a nonionic surfactant in a ratio of at least 0.9:1;

(b) from 0 to 80 wt % of a builder component comprising one or more inorganic or organic detergency builders;

(c) a soil release effective amount of a water-soluble or water-dispersible sulphonated polyester comprising monomer units of (i) an unsulphonated aromatic diacidic monomer (A), (ii) a sulphonated aromatic diacidic monomer (SA)

(iii) optionally a hydroxylated aromatic or aliphatic diacidic monomer (HA), in an amount replacing up to 50 mole % of (A) and/or (SA), (iv) a polyol (P) selected from ethylene glycol, propylene glycol, isopropylene glycol, glycerol, 1,2,4-butanetriol and 1,2,3-butanetriol, and oligomers of these having from 1 to 8 monomer units, the polyester having a sulphur content within the range of from 0.5 to 10 wt %;

(d) optionally other detergent ingredients to 100 wt %.

DETAILED DESCRIPTION OF THE INVENTION

The polyesters

The polyesters with which the invention is concerned are defined above. The polyesters and their preparation are disclosed and claimed in WO 95 32997A (Rhône-Poulenc).

Preferred polyesters have the following features:

the unsulphonated diacidic monomer (A) is an aromatic dicarboxylic acid or an anhydride of a lower ($C_1$–$C_4$) alkyl diester thereof, selected from terephthalic acid, isophthalic acid, 2,6-naphthalene dicarboxylic acid, anhydrides and lower ($C_1$–$C_4$) alkyl diesters thereof;

the sulphonated diacidic monomer (SA) is a sulphonated aromatic dicarboxylic acid, anhydride, or lower ($C_1$–$C_4$) alkyl diester thereof;

the mole ratio (A):[(A)+(SA)] is within the range of from 60:100 to 95:100, preferably from 65:100 to 93:100;

the mole ratio (SA):[(A)+(SA)] is within the range of from 5:100 to 40:100, preferably from 7:100 to 35:100;

the hydroxylated monomer (HA), if present, is a hydroxylated aromatic dicarboxylic acid, or anhydride or lower ($C_1$–$C_4$) dialkyl ester thereof;

the hydroxylated monomer (HA), if present, does not replace more than 30 mole % of (A) and/or (SA);

the quantity of (P) is such that the ratio of OH functional groups of (P) to COOH functional groups (or equivalents) of (A)+(SA)+any (HA) is within the range of from 1.05:1 to 4:1, preferably from 1.1:1 to 3.5:1, and more preferably from 1.8:1 to 3:1;

the polyester has a number average molecular weight of less than 20 000, the sulphur content is within the range of from 1.2 to 8 wt %;

the hydroxyl group content is at least 0.2 OH equivalent per kg of polyester.

The unsulphonated diacidic monomer (A)

As previously indicated, the monomer (A) preferably consists of at least one dicarboxylic acid or anhydride chosen from terephthalic, isophthalic and 2,6 naphthalene-dicarboxylic acids or anhydrides or their diesters.

Preferably, monomer (A) is present in a quantity corresponding to a molar ratio (A)/[(A)+(SA)] within the range of from 95:100 to 60:100, preferably from 93:100 to 65:100.

The unsulphonated diacidic monomer (A) preferably consists of 50 to 100 mole %, more preferably 70 to 90 mole %, of terephthalic acid or anhydride or lower alkyl (methyl, ethyl, propyl, isopropyl, butyl) diester, and of 0 to 50 mole %, more preferably from 10 to 30 mole %, of isophthalic acid or anhydride and/or of 2,6-naphthalenedicarboxylic acid or anhydride or lower alkyl (methyl, ethyl, propyl, isopropyl, butyl) diester; the preferred diesters are methyl diesters.

In the unsulphonated diacidic monomer (A) there may additionally be present minor quantities of aromatic diacids other than those mentioned above, such as orthophthalic acid, anthracene, 1,8-naphthalene, 1,4-naphthalene and biphenyl dicarboxylic acids or aliphatic diacids such as adipic, glutaric, succinic, trimethyladipic, pimelic, azelaic, sebacic, suberic, itaconic and maleic acids, etc. in the form of acid, anhydride or lower (methyl, ethyl, propyl, isopropyl, butyl) diesters.

The sulphonated diacidic monomer (SA)

Preferably, the sulphonated diacidic monomer (SA) consists of at least one sulphonated aromatic or sulphonated aliphatic dicarboxylic acid or anhydride or lower ($C_1$–$C_4$) alkyl diester. Aromatic dicarboxylic acids and their derivatives are preferred.

Preferably, monomer (SA) is present in a quantity corresponding to a molar ratio (SA)/[(A)+(SA)] within the range of from 5:100 to 40:100, more preferably from 7:100 to 35:100.

The sulphonated diacidic monomer (SA) has at least one sulphonic acid group, preferably in the form of an alkali metal (preferably sodium) sulphonate, and two acidic functional groups or acidic functional group equivalents (that is to say an anhydride functional group or two ester functional groups) attached to one or a number of aromatic rings, when aromatic dicarboxylic acids or anhydrides or their diesters are involved, or to the aliphatic chain when aliphatic dicarboxylic acids or anhydrides or their diesters are involved.

Suitable aromatic sulphonated diacidic monomers include sulphoisophthalic, sulphoterephthalic, sulphoortho-phthalic acids or anhydrides, 4-sulpho-2,7-naphthalenedicarboxylic acids or anhydrides, sulpho 4,4'-bis (hydroxycarbonyl) diphenyl sulphones, sulphodiphenyldicarboxylic acids or anhydrides, sulpho 4,4'-bis(hydroxycarbonyl) diphenylmethanes, sulpho-5-phenoxyisophthalic acids or anhydrides or their lower (methyl, ethyl, propyl, isopropyl, butyl) diesters.

Suitable aliphatic sulphonated diacidic monomers (SA) include sulphosuccinic acids or anhydrides or their lower alkyl (methyl, ethyl, propyl, isopropyl, butyl) diesters.

The most preferred sulphonated diacidic monomer (SA) is sulphoisophthalic acid in acid, anhydride or diester (preferably dimethyl ester) form, very particularly dimethyl 5-sodiooxysulphonylisophthalate.

The hydroxylated diacidic monomer (HA)

The hydroxylated diacidic monomer (HA), which is optionally present and can replace up to 50 mole %, preferably up to 30 mole %, of (A) and/or (SA), consists of least one hydroxylated aromatic or aliphatic dicarboxylic acid or anhydride or a lower (C1–C4) alkyl diester thereof.

The hydroxylated diacidic monomer (HA) has at least one hydroxyl group attached to one or a number of aromatic rings when it is an aromatic monomer or to the aliphatic chain when it is an aliphatic monomer. Aromatic monomers are preferred.

Suitable hydroxylated diacidic monomers (HA) include 5-hydroxyisophthalic, 4-hydroxyisophthalic, 4-hydroxyphthalic, 2-hydroxymethylsuccinic, hydroxymethylglutaric and hydroxyglutaric acids, in acid, anhydride or lower alkyl diester form.

The polyol (P)

The polyol (P) may be a oligomer comprising up to 8 monomer units, preferably up to 6 and more preferably up to 4 monomer units, but is most preferably a monomer. The polyol is selected from ethylene glycol, propylene glycol, glycerol, 1,2,4-butanetriol, 1,2,3-butanetriol and combinations of these, and their lower (2 to 8, preferably 2 to 6, more preferably 2 to 4) oligomers.

Preferably, the polyol (P) is present in a quantity corresponding to a ratio of the number of OH functional groups of the polyol (P) to the number of COOH functional groups or functional group equivalents of the total diacidic monomer (A)+(SA)+(HA) within the range of from 1.05:1 to 4:1, preferably from 1.1:1 to 3.5:1 and more preferably from 1.8:1 to 3:1.

The preferred polyols (P) are ethylene glycol and glycerol, ethylene glycol being especially preferred.

Preferably, the sulphonated diacidic monomer (SA) consists of at least one sulphonated aromatic dicarboxylic acid or anhydride or of a mixture of sulphonated aromatic acids or anhydrides and of sulphonated aliphatic acids or anhydrides or their diesters when the polyol (P) does not contain any polyol other than a glycol or when the hydroxylated diacidic monomer (HA) is absent.

Molecular weight

Preferably, the polyester used in accordance with the invention has a number average molecular weight not exceeding 20 000, and preferably not exceeding 15 000.

The molecular weight may be much lower than these limits. Polyesters having molecular weights below 1000, for example, 500–1000, have proved highly effective.

Number average molecular weight may be measured by gel permeation chromatography, for example, in dimethylacetamide containing $10^{-2}$ N of LiBr, at 25° C., or in tetrahydrofuran. The results are expressed as polystyrene equivalents.

Hydroxyl functional group content

Preferably, the hydroxyl functional group content of the polyester, expressed as OH equivalent/kg of polyester, is at least 0.2. The hydroxyl functional group content may be estimated from proton NMR, the measurement being carried out in dimethyl sulphoxide.

The elementary unit considered in the definition of the mole of monomer (A), (SA) or (HA) is the COOH functional group in the case of the diacids or the COOH functional group equivalent in the case of the anhydrides or of the diesters.

Especially preferred polyesters

An especially preferred polyester is obtainable from the following monomers:

- terephthalic acid (A1) in lower alkyl (preferably methyl) diester form;
- optionally isophthalic acid (A2) in acid or anhydride form;
- optionally a hydroxylated terephthalic or isophthalic acid (HA) in acid or anhydride form; the mole ratio (A1):[(A1)+(A2)] or (A1):[A1+HA)] or (A1):[(A1)+(A2)+(HA)] being within the range of from 50:100 to 100:100, preferably from 70:100 to 90:100;
- sulphoisophthalic acid (SA), preferably in lower alkyl, preferably methyl, diester form; and
- monoethylene glycol and/or glycerol (P).

Preferred polyesters in accordance with the invention, based on terephthalic acid, isophthalic acid, sulphoisophthalic acid and monoethylene glycol, may be described as having backbone units of the following formula:

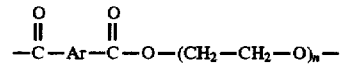

$$-\overset{O}{\overset{\|}{C}}-Ar-\overset{O}{\overset{\|}{C}}-O-(CH_2-CH_2-O)_n-$$

where Ar=terephthalic, isophthalic or sulphoisophthalic, and n represents 1, 2, 3 or 4. Typical mole percentages for the different values of n are as follows:

| | |
|---|---|
| n = 1 | 58.7 |
| n = 2 | 30.5 |
| n = 3 | 8.8 |
| n = 4 | 1.9, |

only trace quantities, if any, of polyethylene oxide units in which n is greater than four being present.

The majority of endgroups are of the formula $$Ar-COO-(CH_2-CH_2-O-)_n$$

wherein n is 1, 2, 3 or 4, a minority being of the formulae $$-Ar-COOH \text{ or } -Ar-COOR$$

wherein R is a lower alkyl group, preferably methyl.

These polyesters, unlike many disclosed in the prior art, are not end-capped with hydrocarbon or sulphonated capping groups.

Preparation of the polyesters

The polyesters may be prepared by the usual esterification and/or transesterification and polycondensation processes, for example, by esterification and/or transesterification in the presence of a catalyst of the polyol P with the various diacidic monomers (in acid, anhydride or diester form), and polycondensation of the polyol esters at reduced pressure in the presence of a polycondensation catalyst.

A preferred process for the preparation of the polyesters is disclosed and claimed in WO 95 32997A (Rhône-Poulenc).

Detergent compositions

The polyesters are suitably incorporated into detergent compositions in amounts of from 0.01 to 10 wt %, preferably from 0.1 to 5 wt % and more preferably from 0.25 to 3 wt %.

The detergent compositions of the invention also contain, as essential ingredients, one or more detergent-active compounds (surfactants), and may also contain one or more detergency builders; they may also optionally contain bleaching components and other active ingredients to enhance performance and properties.

The surfactant system

The compositions of the invention contain a surfactant system which includes a sulphate or sulphonate type anionic surfactant as the sole or principal surfactant. If nonionic surfactant is also present, the weight ratio of anionic surfactant to nonionic surfactant is at least 0.9:1, preferably at least 1:1 and more preferably within the range of from 1:1 to 3:1.

Many suitable anionic and nonionic detergent-active compounds are available and are fully described in the literature, for example, in "Surface-Active Agents and Detergents", Volumes I and II, by Schwartz, Perry and Berch.

The total amount of surfactant present ranges from 2 to 50 wt %, preferably from 5 to 40 wt %. The amount of anionic surfactant present preferably ranges from 5 to 45 wt %, and more preferably from 10 to 40 wt %.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

The polyesters of the present invention are especially suitable for use in compositions containing primary alkyl sulphates, alkyl ether sulphates, alkylbenzene sulphonates, and mixtures of these. Most preferred are alkylbenzene sulphonates, primary alkyl sulphates, and combinations of these.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Especially preferred are ethoxylated nonionic surfactants, alkylpolyglycosides, and mixtures of these.

As well as the non-soap surfactants listed above, detergent compositions of the invention may also advantageously contain fatty acid soap. If desired, other surfactants, for example, cationic, amphoteric and zwitterionic detergent-active compounds, and mixtures thereof, may be present in minor amounts.

The detergency builder system

The detergent compositions of the invention will generally also contain one or more detergency builders. The total amount of detergency builder in the compositions may suitably range from 5 to 80 wt %, preferably from 10 to 60 wt %.

Inorganic builders that may be present include sodium carbonate, if desired in combination with a crystallisation seed for calcium carbonate, as disclosed in GB 1 437 950 (Unilever); crystalline and amorphous aluminosilicates, for example, zeolites as disclosed in GB 1 473 201 (Henkel), amorphous aluminosilicates as disclosed in GB 1 473 202 (Henkel) and mixed crystalline/amorphous aluminosilicates as disclosed in GB 1 470 250 (Procter & Gamble); and layered silicates as disclosed in EP 164 514B (Hoechst). Inorganic phosphate builders, for example, sodium orthophosphate, pyrophosphate and tripolyphosphate, may also be present.

According to one preferred embodiment of the invention, the compositions contain an alkali metal, preferably sodium, aluminosilicate builder. Sodium aluminosilicates may generally be incorporated in amounts of from 10 to 70% by weight (anhydrous basis), preferably from 25 to 50 wt %.

The zeolite may be the commercially available zeolite 4A now widely used in laundry detergent powders. Other zeolites that may be used include zeolites X and Y. Alternatively, and preferably, the zeolite builder incorporated in the compositions of the invention is maximum aluminium zeolite P (zeolite MAP) as described and claimed in EP 384 070B (Unilever). Zeolite MAP is defined as an alkali metal aluminosilicate of the zeolite P type having a silicon to aluminium ratio not exceeding 1.33.

Especially preferred is zeolite MAP having a silicon to aluminium ratio not exceeding 1.07, more preferably about 1.00. The calcium binding capacity of zeolite MAP is generally at least 150 mg CaO per g of anhydrous material.

According to another preferred embodiment of the invention, the builder system comprises at least 5 wt %, and preferably at least 10 wt %, of sodium tripolyphosphate (the percentages being based on the detergent composition).

Sodium tripolyphosphate is suitably present in an amount of from 5 to 50 wt %; if sole builder, it is suitably present in an amount of from 20 to 50 wt %.

Sodium tripolyphosphate may also advantageously be used in combination with other builders, most preferably, sodium carbonate, sodium orthophosphate, sodium pyrophosphate, or sodium aluminosilicate (zeolite). One preferred mixed builder system comprises at least 5 wt % sodium tripolyphosphate in combination with at least 10 wt % of zeolite A.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts. This list is not intended to be exhaustive.

Detergent compositions according to the invention may also suitably contain a bleach system, which may contain peroxy bleach compounds, for example, inorganic persalts or organic peroxyacids, capable of yielding hydrogen peroxide in aqueous solution. Suitable peroxy bleach compounds include organic peroxides such as urea peroxide, and inorganic persalts such as the alkali metal perborates, percarbonates, perphosphates, persilicates and persulphates.

Preferred inorganic persalts are sodium perborate monohydrate and tetrahydrate, and sodium percarbonate. The peroxy bleach compound is suitably present in an amount of from 5 to 35 wt %, preferably from 10 to 25 wt %.

The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %.

A bleach stabiliser (heavy metal sequestrant) may also be present. Suitable bleach stabilisers include ethylenediamine tetraacetate (EDTA) and the polyphosphonates such as ethylenediamine tetramethylene phosphonate (EDTMP) and its salts, and diethylenetriamine pentamethylene phosphonate (DETPMP) and its salts.

The present invention is also of especial applicability to non-bleaching compositions suitable for washing delicate fabrics. Such compositions may, for example, have one or more of the following characteristics:

- a 1 wt % aqueous solution pH, in demineralised water, not exceeding 10.5, and preferably not exceeding 10;
- absence, or an extremely low level, of fluorescer;
- presence of a polycarboxylate polymer, for example, an acrylic/maleic copolymer such as Sokalan (Trade Mark) CP5 ex BASF;
- presence of a polymer effective to inhibit dye transfer, for example, polyvinyl pyrrolidone;
- presence of a heavy metal sequestrant, for example, the aminomethylenephosphonic acids and salts such as EDTMP and DETPMP mentioned above in the context of bleach stabilisation.

The compositions of the invention may also contain one or more enzymes. Suitable enzymes include the proteases, amylases, cellulases and lipases usable for incorporation in detergent compositions.

Preferred proteolytic enzymes (proteases) are normally solid, catalytically active protein materials which degrade or alter protein types of stains when present as in fabric stains in a hydrolysis reaction. They may be of any suitable origin, such as vegetable, animal, bacterial or yeast origin.

Proteolytic enzymes or proteases of various qualities and origins and having activity in various pH ranges of from 4–12 are available and can be used in the instant invention. Examples of suitable proteolytic enzymes are the subtilisins, which are obtained from particular strains of *B. subtilis* and *B. licheniformis*, such as the commercially available subtilisins Maxatase (Trade Mark), as supplied by Gist-Brocades N. V., Delft, Holland, and Alcalase (Trade Mark), as supplied by Novo Industri A/S, Copenhagen, Denmark.

Also suitable is a protease obtained from a strain of Bacillus having maximum activity throughout the pH range of 8–12, being commercially available, e.g. from Novo Industri A/S under the registered trade-names Esperase (Trade Mark) and Savinase (Trade Mark). The preparation of these and analogous enzymes is described in GB 1 243 785. Other commercial proteases are Kazusase (Trade Mark) (obtainable from Showa-Denko of Japan), Optimase (Trade Mark) (from Miles Kali-Chemie, Hannover, West Germany), and Superase (Trade Mark) (obtainable from Pfizer of U.S.A.).

Proteases having isoelectric points below 10 include Alcalase, Maxatase, Optimase and Primase (all Trade Marks). Proteases having isoelectric points of 10 or above include Savinase, Maxacal, Purafect, Opticlean and Esperase (all Trade Marks).

Detergency enzymes are commonly employed in granular form in amounts of from 0.01 to 5.0 wt %.

Other materials that may be present in detergent compositions of the invention include inorganic salts such as sodium carbonate, sodium sulphate or sodium silicate; antiredeposition agents such as cellulosic polymers; fluorescers; inorganic salts such as sodium sulphate; lather control agents or lather boosters as appropriate; dyes; coloured speckles; perfumes; foam controllers; and fabric softening compounds. This list is not intended to be exhaustive.

Detergent compositions of the invention may be of any suitable physical form, for example, powders or granules, liquids, gels and solid bars.

Detergent compositions of the invention may be prepared by any suitable method. Particulate detergent compositions are suitably prepared by spray-drying a slurry of compatible heat-insensitive ingredients, and then spraying on or post-dosing those ingredients unsuitable for processing via the slurry. The skilled detergent formulator will have no difficulty in deciding which ingredients should be included in the slurry and which should not.

Particulate detergent compositions of the invention preferably have a bulk density of at least 400 g/l, more preferably at least 500 g/l. Especially preferred compositions have bulk densities of at least 650 g/litre, more preferably at least 700 g/litre.

Such powders may be prepared either by post-tower densification of spray-dried powder, or by wholly non-tower methods such as dry mixing and granulation; in both cases a high-speed mixer/granulator may advantageously be used. Processes using high-speed mixer/granulators are disclosed, for example, in EP 340 013A, EP 367 339A, EP 390 251A and EP 420 317A (Unilever).

EXAMPLES

The invention is further illustrated by the following non-limiting Examples, in which parts and percentages are by weight unless otherwise stated. Throughout the Examples * denotes a Trade Mark.

Polymers

The polymer in accordance with the invention used (Polymer 1) was a water-soluble sulphonated polyester of terephthalic acid, isophthalic acid, sulphoisophthalic acid and ethylene glycol having the following approximate composition:

- diacidic monomer comprising approximately 77 mole % terephthalate, 3.7 mole % isophthalate, 18.2 mole % sulphoisophthalate;
- ratio of OH groups ex ethylene glycol to COOH groups ex diacid monomers approximately 1.22;
- number average molecular weight, by GPC in tetrahydrofuran at 25°0 C. with calibration against polystyrene standards, 534; weight average molecular weight 1667;
- sulphur content 2.4 wt %;
- hydroxyl group content approximately 1.4–1.5 per kg polymer.

For comparative purposes, the following commercially available polymers were used:

Polymer A: Sokalan (Trade Mark) HP22 ex BASF, a graft copolymer of polyethylene glycol and polyvinyl acetate.

Polymer B: Repel-O-Tex (Trade Mark) ex Rhône-Poulenc, a PET/POET polymer, used in the form of a granule (50% wt % polymer, 50 wt % sodium sulphate).

Polymer C: Aquaperle (Trade Mark) 3991 ex ICI, a PET/POET polymer.

EXAMPLE 1

Zeolite-built particulate bleaching detergent compositions of high bulk density (870 g/litre) containing zeolite MAP were prepared to the following general formulation, by non-tower granulation and postdosing techniques:

| | % |
|---|---|
| Primary alkyl sulphate (cocoPAS) | 9.17 |
| Nonionic surfactant (7E0), linear | 5.93 |
| Nonionic surfactant (3E0), linear | 3.95 |
| Hardened tallow soap | 1.55 |
| Zeolite MAP (anhydrous basis) | 32.18 |
| Sodium citrate (2aq) | 4.25 |
| Sodium carbonate (light) | 2.30 |
| Fluorescer | 0.05 |
| Sodium carboxymethylcellulose (70%) | 0.88 |
| Sodium percarbonate ($AvO_2$ 13.25) | 20.50 |
| TAED (83% granule) | 6.50 |
| EDTMP (Dequest* 2047) | 0.42 |
| Protease (Maxacal* CX600k 2019 GU/mg) | 1.50 |
| Lipase (Lipolase* 100T 287 LU/mg) | 0.25 |
| Amylase (Termamyl* 60T 4.3 MU/mg) | 0.05 |
| Antifoam/fluorescer granule | 4.00 |
| Sodium bicarbonate | 1.00 |
| Perfume | 0.45 |
| Soil release polymer (see below) | 0 or 0.40 |
| Minor ingredients | to 100.00 |

Soil release and detergency were measured using radio ($^3H$)-labelled triolein as a soil. The wash regime was as follows: polyester cloths were washed for 20 minutes in Tergotometers in the test formulations (with or without soil release polymer at 0.4 wt %), at the product dosages stated, at 40° C. in 24° FH. (calcium only) water.

Single wash: soiled cloths were washed as described above.

Prewash: as single wash but no soil present; after prewash the fabrics were rinsed in a beaker with 1 litre of water at 20° C. and dried overnight.

Main wash: as for single wash but using pretreated fabrics.

Deteraency results

Product dosage: 4.8 g/litre

| Polymer | % Detergency | |
|---|---|---|
| (0.4 wt %) | Single wash | Prewash + main wash |
| None | 15.6 | 5.3 |
| Polymer 1 | 76.9 | 87.5 |
| Polymer A | 18.5 | 7.9 |
| Polymer B | 39.8 | 62.3 |
| Polymer C | 44.9 | 69.9 |

EXAMPLE 2

Phosphate-built particulate detergent compositions were prepared to the following general formulation, using spray-drying and postdosing techniques:

| | |
|---|---|
| Na linear alkylbenzene sulphonate | 25.00 |
| Zeolite | 1.17 |
| Sodium tripolyphosphate | 21.68 |

-continued

| | |
|---|---|
| Sodium silicate | 5.00 |
| Calcium carbonate | 10.00 |
| Sodium sulphate | 21.24 |
| Sodium carboxymethylcellulose | 0.70 |
| Fluorescer | 0.01 |
| Acrylic/maleic copolymer (Sokalan* CP5) | 1.80 |
| Perfume | 0.25 |
| Protease (Savinase* 6T) | 0.20 |
| Lipase (Lipolase* 100T) | 0.05 |
| Amylase (Termamyl* 60T) | 0.08 |
| Antifoam (silicone oil/silica) | 0.01 |
| Soil release polymer | see below |
| Moisture and impurities | to 100.00 |

The formulations had a bulk density of 420–440 g/litre and a 1 wt % aqueous solution pH in demineralised water at 25° C. of 9.7–9.8.

Soil release and detergency on knitted polyester test cloths stained with Oilsol Blue dye/olive oil, were assessed in the tergotometer at two different product dosages, using the following wash regimes:

| | 3.8 g/l | 1.3 g/l |
|---|---|---|
| Water hardness | 25:3 Ca:Mg | 15:3 Ca:Mg |
| pH | 8.45 | 8.22 |
| Temperature | 28° C. | |
| Soak/wash time | 30 min soak/10 min wash | |
| Prewashes | 5 | |
| Replicates | 2 | |

Detergency was assessed by measuring reflectance before and after washing using Micromatch (Trade Mark) apparatus. The differences (ΔR 580*) are shown in the following Table:

| Polymer | % | 3.8 g/l | 1.3 g/l |
|---|---|---|---|
| None | 0 | 32.68 | 22.94 |
| Polymer 1 | 0.5 | 57.29 | 63.02 |
| Polymer A | 1.0 | 50.63 | 27.96 |
| Polymer B | 0.5 | 52.05 | 50.41 |

Stain removal was also assessed visually by an experienced panel of five people. The results, expressed on a scale of 1 (heavy staining, initial stain) to 10 (complete removal), were as follows:

| Polymer | % | 3.8 g/l | 1.3 g/l |
|---|---|---|---|
| Initial | — | 1 | 1 |
| None | 0 | 3 | 3 |
| Polymer 1 | 0.5 | 10 | 10 |
| Polymer A | 1.0 | 6 | 4 |
| Polymer B | 0.5 | 8 | 8 |

EXAMPLE 3

Further phosphate-built particulate detergent compositions were prepared to the following general formulation, using spray-drying and postdosing techniques:

| | |
|---|---|
| Na linear alkylbenzene sulphonate | 25.00 |
| Sodium tripolyphosphate | 22.50 |
| Sodium silicate | 5.00 |

-continued

| | |
|---|---|
| Sodium sulphate | 28.90 |
| Sodium carboxymethylcellulose | 0.70 |
| Acrylic/maleic copolymer (Sokalan* CP5) | 2.00 |
| Sodium carbonate | 2.00 |
| Fluorescer speckles | 1.00 |
| Citric acid (anhydrous) | 3.00 |
| Protease (Opticlean* M375) | 0.784 |
| Lipase (Lipolase* 100T) | 0.253 |
| Antifoam (silicone oil/silica) | 0.04 |
| Perfume | 0.33 |
| Soil release polymer | see below |
| Moisture and impurities | to 100.00 |

The formulations had a bulk density of 370–430 g/litre and a 1 wt % aqueous solution pH in demineralised water at 25° C. of 9.7–9.8.

Detergency was assessed, as in Example 2, by measuring reflectance before and after washing using Micromatch (Trade Mark) apparatus. The differences (ΔR 580*) are shown in the following Table:

| Polymer | % | 3.8 g/l | 1.3 g/l |
|---|---|---|---|
| None | 0 | 30.34 | 38.56 |
| Polymer 1 | 0.25 | 57.84 | 60.67 |
| Polymer A | 1.0 | 53.23 | 59.48 |
| Polymer B | 0.25 | 53.71 | 61.77 |
| Polymer B | 0.35 | 54.50 | 58.53 |

Soil release properties were also assessed at a product dosage of 1.3 g/l, by measuring relectance after a first wash and again after a second wash. The wash regime in the tergotometer was as follows:

| | |
|---|---|
| Test cloth | Knitted polyester |
| Stain | Oilsol Violet/olive oil |
| Water hardness | 21:6 Ca:Mg |
| Temperature | 28° C. |
| Prewashes | none |
| Soak/wash time | 30 min soak/10 min wash |
| Rinse time | 2 × 2 min |

Results

| | | R 580* | | | |
|---|---|---|---|---|---|
| Polymer | % | Wash 1 | Wash 2 | Difference | |
| None | 0 | 42.30 | 44.49 | 2.19 ) | 2.70 |
| | | 43.34 | 46.55 | 3.21 ) | |
| 1 | 1.0 | 46.75 | 58.31 | 11.56 ) | 12.99 |
| | | 56.05 | 70.47 | 14.42 ) | |
| B | 1.0 | 50.45 | 60.52 | 10.07 ) | 10.12 |
| | | 45.58 | 55.75 | 10.17 ) | |

EXAMPLE 4

In this Example, the effects of Polymers 1 and B were compared in a series of formulations having varying ratios of anionic surfactant to nonionic surfactant.

Ingredients were dosed separately into tergotometers to produce formulations as follows:

| | Parts by weight |
|---|---|
| Surfactant system (see below) | 20.00 |
| Sodium tripolyphosphate | 22.00 |
| Sodium carbonate | 25.00 |
| Sodium chloride | 20.00 |
| Soil release polymer (1 or B) | 0 or 1.00 |

The surfactant system consisted of linear alkylbenzene sulphonate (LAS), alone or in combination with nonionic surfactant (6.5EO linear and 3EO linear in a ratio of 3:2) at various ratios.

Soil release and detergency on polyester cloths soiled with radio($^3$H)labelled triolein were measured, as in Example 1, using the single-wash regime described in Example 1 (20 minutes, 25° C., 24° FH. (calcium only) water). The "product" dosage was 1.5 g/l. Results were as follows:

| LAS:nonionic | No polymer | Polymer 1 | Polymer B |
|---|---|---|---|
| 100:0 | 60.0 | 72.2 | 55.4 |
| 90:10 | 50.0 | 70.3 | 44.6 |
| 82.5:17.5 | 34.6 | 63.3 | 32.9 |
| 75:25 | 16.6 | 56.3 | 49.7 |
| 50:50 | 12.6 | 48.9 | 28.0 |
| 37.5:62.5 | 7.3 | 20.7 | 16.9 |

EXAMPLES 5 to 7

Examples of phosphate-built non-bleaching high bulk density particulate detergent compositions containing soil release polymers of the invention are as follows:

| | 5 | 6 | 7 |
|---|---|---|---|
| Na LAS[1] | 28.66 | 24.70 | 15.00 |
| Na PAS[2] | 2.88 | 4.19 | — |
| Nonionic 9E0 | — | — | 2.51 |
| Zeolite | 18.84 | 21.31 | 6.24 |
| Na tripolyphosphate | 29.69 | 6.78 | 39.25 |
| Na carbonate | — | 16.43 | 23.52 |
| Na bicarbonate | 6.26 | — | 2.97 |
| Na silicate | — | 2.37 | |
| SCMC | 0.78 | 0.78 | 0.57 |
| Fluorescer | 0.01 | 0.56 | 0.30 |
| Copolymer (Sokalan* CP5) | 1.93 | 1.99 | 1.18 |
| Protease (Savinase* 6T) | 0.32 | 0.40 | 0.70 |
| Lipase (Lipolase* 100T) | 0.08 | 0.10 | 0.26 |
| Amylase (Termamyl* 60T) | 0.14 | — | — |
| Soil release polymer | 0.50 | 0.50 | 0.50 |
| Perfume | 0.40 | 0.40 | 0.60 |
| Moisture and impurities | | to 100.00 | |
| Bulk density (g/liter) | 780–820 | ca. 800 | ca. 800 |

[1]Sodium linear alkylbenzene sulphonate
[2]Sodium primary alcohol sulphate

The composition of Example 5 is of low solution pH (9.7–9.8) and is especially suitable for washing delicate fabrics.

EXAMPLE 8

A further example of a high bulk density non-bleaching phosphate-built powder of low solution pH in accordance with the invention, suitable for washing delicate fabrics, is as follows:

| | |
|---|---|
| Na LAS | 6.50 |
| Nonionic 6/7E0 | 4.00 |
| Soap | 4.30 |
| Na tripolyphosphate | 29.17 |
| Na silicate | 10.00 |
| SCMC | 0.43 |
| Polyvinyl pyrrolidone | 0.95 |
| Na sulphate | 17.00 |
| Na carbonate (heavy) | 6.00 |
| Ammonium sulphate | 2.00 |
| Citric acid | 2.25 |
| Na metasilicate | 2.00 |
| Amorphous aluminosilicate | 1.12 |
| Protease (Savinase* 6T) | 0.20 |
| Lipase (Lipolase* 100T) | 0.05 |
| Amylase (Termamyl* 60T) | 0.25 |
| Cellulase (Celluzyme* 0.7T) | 0.40 |
| Soil release polymer | 0.55 |
| Perfume | 0.40 |
| Moisture and impurities | to 100.00 |

The bulk density of this formulation is 700 g/litre and the 1 wt % aqueous solution pH in demineralised water is 9.7–9.8.

EXAMPLES 9 and 10

Examples of high bulk density phosphate-built bleaching particulate detergent compositions in accordance with the invention are as follows:

| | 9 | 10 |
|---|---|---|
| Na LAS | 6.50 | 9.00 |
| Nonionic 6/7E0 | 4.00 | 4.00 |
| Soap | 4.30 | — |
| Na tripolyphosphate | 28.40 | 30.00 |
| Na silicate | 10.00 | 10.00 |
| SCMC | 0.36 | 0.36 |
| Fluorescer | 0.20 | 0.20 |
| EDTA | 0.06 | 0.06 |
| Na carbonate (heavy) | 18.50 | 18.72 |
| Citric acid | 2.25 | 2.25 |
| Na perborate $4H_2O$ | 8.55 | 8.55 |
| TAED | 2.08 | 2.08 |
| Amorph. aluminosilicate | 0.86 | 0.97 |
| Protease (Savinase* 4.8T) ) | 0.65 | 1.00 |
| Lipase (Lipolase* 100T) ) | | |
| Soil release polymer | 0.55 | 0.55 |
| Perfume | 0.40 | 0.40 |
| Moisture and impurities | to 100.00 | |
| Bulk density (g/liter) | 700 | 700 |

EXAMPLES 11 and 12

Examples of phosphate-built spray-dried non-bleaching particulate detergent compositions in accordance with the invention containing high levels of anionic surfactant are as follows:

| | 11 | 12 |
|---|---|---|
| Na LAS | 26.00 | 26.00 |
| Na tripolyphosphate | 26.00 | 26.00 |
| Na alkaline silicate | 9.00 | 9.16 |
| Sodium sulphate (in base) | 14.57 | 9.71 |
| SCMC | 1.00 | 1.00 |
| Fluorescer | 0.25 | 0.25 |
| Sodium carbonate | 10.00 | 10.00 |
| Sodium sulphate (postdosed) | — | 6.41 |
| Enzyme (Maxacal* 600000) | 0.14 | 0.20 |

-continued

| | 11 | 12 |
|---|---|---|
| Soil release polymer | 0.50 | 0.50 |
| EDTA, colour, nonionic surfactant, water, perfume | to 100.00 | |
| Bulk density (g/liter) | 365–435 | 365–435 |

EXAMPLES 13 and 14

Examples of phosphate-built high bulk density non-bleaching particulate detergent compositions in accordance with the invention containing high levels of anionic surfactant are as follows:

| | 13 | 14 |
|---|---|---|
| Na LAS | 26.00 | 26.00 |
| Na tripolyphosphate | 26.00 | 26.00 |
| Na alkaline silicate | 9.53 | 9.53 |
| Sodium sulphate (in base) | 12.52 | 12.52 |
| SCMC | 1.04 | 1.04 |
| Fluorescer | 0.26 | 0.26 |
| Sodium carbonate | 8.47 | 8.53 |
| Zeolite A (as hydrated) | 3.00 | 3.00 |
| Enzymes: Savinase*/Lipolase* | 0.50 | 0.50 |
| Soil release polymer | 0.50 | 0.50 |
| Perfume | 0.25 | 0.30 |
| EDTA, colour, water etc | to 100.00 | |
| Bulk density (g/liter) | 720–800 | 720–800 |

EXAMPLE 15

An example of a high bulk density phosphate-built bleaching particulate detergent composition in accordance with the invention containing a high level of anionic surfactant is as follows:

| | |
|---|---|
| Na LAS | 26.355 |
| Na tripolyphosphate | 24.478 |
| Na alkaline silicate | 8.931 |
| Sodium sulphate (in base) | 8.215 |
| SCMC | 0.938 |
| Fluorescer | 0.149 |
| Sodium carbonate | 5.365 |
| Zeolite A (as hydrated) | 3.576 |
| Sodium perborate (monohydrate) | 7.294 |
| TAED green granules | 2.824 |
| BDTMP (Dequest* 2047) | 0.471 |
| Enzymes: Savinase*/Lipolase* | 0.224 |
| Kazusase* | 0.224 |
| Soil release polymer | 0.500 |
| Perfume | 0.300 |
| EDTA, colour, water etc | to 100.00 |
| Bulk density | 720–800 g/liter |

EXAMPLES 16 and 17

Further examples of phosphate-built non-bleaching particulate detergent compositions in accordance with the invention, one spray-dried and the other of high bulk density, are as follows:

| | 16 | 17 |
|---|---|---|
| Na LAS | 6.50 | 11.25 |
| Na tripolyphosphate | 28.00 | 39.25 |
| Na alkaline silicate | 9.00 | 4.13 |

-continued

| | 16 | 17 |
|---|---|---|
| Sodium sulphate (in base) | 24.30 | 5.42 |
| EDTA | 0.01 | 0.004 |
| SCMC | 1.00 | 1.00 |
| Fluorescer | 0.38 | 0.38 |
| Nonionic surfactant 7E0 | 3.00 | 5.00 |
| Soap | 5.00 | — |
| Antifoam granule | — | 2.00 |
| Sodium carbonate | 12.00 | 22.68 |
| Enzymes: Savinase*/Lipolase* | 0.22 | 0.70 |
| Soil release polymer | 0.50 | 0.50 |
| Perfume | 0.15 | 0.30 |
| EDTA, colour, water etc | to 100.00 | |
| Bulk density (g/liter) | 375–425 | 760–840 |

EXAMPLE 18

An example of a phosphate- and carbonate-built spray-dried particulate detergent composition in accordance with the invention containing a high level of anionic surfactant, a bleach system and a photobleach, is as follows:

| | |
|---|---|
| Na LAS | 22.00 |
| Na carbonate (heavy) | 15.00 |
| Na tripolyphosphate | 13.30 |
| Na alkaline silicate | 7.30 |
| Na sulphate | 22.30 |
| Na perborate | 8.00 |
| TAED | 2.40 |
| SCMC | 0.35 |
| EDTMP | 0.40 |
| Protease (Savinase* 6T) | 0.65 |
| Lipase (Lipolase* 100T) | 0.13 |
| Fluorescer | 0.20 |
| Cu phthalocyanine | 0.011 |
| Soil release polymer | 0.50 |
| Perfume | 0.25 |
| Moisture and impurities | to 100.00 |
| Bulk density | 460 g/liter |

EXAMPLE 19

An example of a zeolite-built high bulk density non-bleaching particulate detergent composition of the invention is as follows:

| | |
|---|---|
| Na LAS | 16.00 |
| Nonionic surfactant | 8.00 |
| Zeolite A (as anhydrous) | 44.50 |
| Na carbonate (light) | 26.46 |
| Fluorescer | 0.27 |
| SCMC | 0.40 |
| Na carbonate (dense) | 3.00 |
| Enzymes (Savinase*/Lipolase*) | 1.50 |
| Soil release polymer | 0.50 |
| Perfume | 0.50 |
| Bulk density | 820 g/liter |

EXAMPLE 20

A further example of a zeolite-built high bulk density non-bleaching particulate detergent composition in accordance with the invention, prepared by batch densification of a spray-dried powder, is as follows:

| | |
|---|---|
| Na LAS | 15.26 |
| Na soap (stearate) | 1.92 |
| Nonionic 7E0 | 7.83 |
| Zeolite A (as anhydrous) | 38.18 |
| Na carbonate (dense) | 9.40 |
| Na carbonate (light) | 7.13 |
| SCMC | 0.59 |
| Fluorescer | 0.17 |
| Acrylic/maleic copolymer | 0.94 |
| Na silicate | 3.11 |
| Na sulphate | 1.75 |
| Silicone Oil | 0.02 |
| Protease (Savinase 6.0T) | 2.00 |
| Lipase (Lipolase 100T) | 0.25 |
| Soil release polymer | 0.50 |
| Moisture etc | to 100.00 |
| Bulk density | 800–900 g/liter |

EXAMPLES 21 and 22

Examples of high bulk density non-bleaching particulate detergent compositions in accordance with the invention containing mixed zeolite, phosphate and carbonate builders are as follows:

| | 21 | 22 |
|---|---|---|
| Na LAS | 18.00 | 22.00 |
| Nonionic 7E0 | 1.60 | 2.00 |
| Na soap (stearate) | — | 2.00 |
| Na tripolyphosphate | 22.50 | 28.00 |
| Zeolite A (anhydrous basis) | 8.00 | 12.00 |
| Na carbonate | 25.00 | 27.00 |
| Fluorescer | 0.12 | 0.12 |
| SCMC | 0.55 | 0.55 |
| Na sulphate | 19.50 | 0.49 |
| Savinase* 6.0T/Lipolase* 100T | 0.75 | 0.75 |
| Soil release polymer | 0.50 | 0.50 |
| Perfume | 0.35 | 0.35 |
| Moisture and minor ingredients | to 100.00 | |
| Bulk density (g/liter) | 850 | 840 |

We claim:

1. A detergent composition for washing fabrics, comprising:

(a) from 2 to 50 wt % of an organic surfactant system which comprises a sulphate or sulphonate type anionic surfactant, optionally in combination with a nonionic surfactant in a ratio of at least 0.9:1;

(b) from 0 to 80 wt % of a builder component comprising one or more inorganic or organic detergency builders;

(c) a soil release effective amount of a water-soluble or water-dispersible non-end-capped sulphonated polyester consisting essentially of monomer units of (i) an unsulphonated aromatic diacidic monomer (A), (ii) a sulphonated aromatic diacidic monomer (SA)

(iii) optionally a hydroxylated aromatic or aliphatic diacidic monomer (HA), in an amount replacing up to 50 mole % of (A) and/or (SA), (iv) a polyol (P) selected from ethylene glycol, propylene glycol, isopropylene glycol, glycerol, 1,2,4-butanetriol and 1,2,3-butanetriol, and oligomers of these having from 1 to 8 monomer units, the polyester having a sulphur content within the range of from 0.5 to 10 wt %;

(d) optionally other detergent ingredients to 100 wt %.

2. A detergent composition as claimed in claim 1, which comprises from 0.01 to 10 wt % of the polyester (c).

3. A detergent composition as claimed in claim 1, which comprises from 0.1 to 5 wt % of the polyester (c).

4. A detergent composition as claimed in claim 1, wherein the surfactant system comprises anionic surfactant only.

5. A detergent composition as claimed in claim 1, wherein the surfactant system comprises anionic and nonionic surfactants in a weight ratio of at least 1:1.

6. A detergent composition as claimed in claim 5, wherein the surfactant system comprises anionic and nonionic surfactants in a weight ratio within the range of from 1:1 to 3:1.

7. A detergent composition as claimed in claim 1, wherein the anionic surfactant is selected from the group consisting of primary alkyl sulphate, linear alkylbenzene sulphonate and mixtures thereof.

8. A detergent composition as claimed in claim 1, wherein the anionic surfactant is present in an amount of from 5 to 45 wt %.

9. A detergent composition as claimed in claim 1, which comprises from 5 to 80 wt % of a detergency builder system.

10. A detergent composition as claimed in claim 9, wherein the detergency builder system comprises zeolite P having a silicon to aluminium ratio not exceeding 1.33:1.

* * * * *